US010753139B2

(12) United States Patent
Wang

(10) Patent No.: US 10,753,139 B2
(45) Date of Patent: Aug. 25, 2020

(54) DOOR SILL ASSEMBLY FOR A DOOR

(71) Applicant: Nan Ya Plastics Corporation, Taipei (TW)

(72) Inventor: Kuei-Yung Wang, Taipei (TW)

(73) Assignee: NAN YA PLASTICS CORPORATION (TW)

( * ) Notice: Subject to any disclaimer, the term of this patent is extended or adjusted under 35 U.S.C. 154(b) by 0 days.

(21) Appl. No.: 16/658,214

(22) Filed: Oct. 21, 2019

(65) Prior Publication Data

US 2020/0048954 A1 Feb. 13, 2020

(51) Int. Cl.
*E06B 1/70* (2006.01)
*E06B 7/23* (2006.01)

(52) U.S. Cl.
CPC ..... *E06B 1/70* (2013.01); *E06B 7/2316* (2013.01)

(58) Field of Classification Search
CPC ..... E06B 2001/707; E06B 7/2316; E06B 1/70
See application file for complete search history.

(56) References Cited

U.S. PATENT DOCUMENTS 3,079,652 A * 3/1963 Wahlfeld ..... E06B 1/70 49/469
3,402,512 A * 9/1968 Peterson ..... E06B 1/70 49/468
3,521,404 A * 7/1970 Hager ..... E06B 1/70 49/468
4,003,162 A * 1/1977 Britt ..... E06B 1/70 49/468
4,079,550 A * 3/1978 Bursk ..... E06B 1/70 428/344
4,104,830 A * 8/1978 Eagle ..... E06B 1/70 49/468
4,156,325 A * 5/1979 McMullen ..... E06B 1/70 49/468
4,310,991 A * 1/1982 Seely ..... E06B 1/70 49/470
4,492,062 A * 1/1985 Levenez ..... E06B 1/705 52/209
4,513,536 A * 4/1985 Giguere ..... E06B 7/2316 49/470
5,179,804 A * 1/1993 Young ..... E06B 1/70 49/468
5,517,788 A * 5/1996 McGough ..... E06B 1/70 49/467
5,943,825 A * 8/1999 Procton ..... E06B 1/70 49/469
6,044,600 A * 4/2000 McCollough ..... E06B 1/70 52/209
6,789,358 B2 * 9/2004 Procton ..... E06B 1/6092 49/467

(Continued)

*Primary Examiner* — Justin B Rephann
(74) *Attorney, Agent, or Firm* — Ostrolenk Faber LLP

(57) ABSTRACT

A door sill assembly for a door comprises a sill, having a lower portion and an adjustable upper portion positioned on the lower portion. The adjustable upper portion is vertically displaceable relative to the lower portion by movement of an adjuster that is available for manipulation when said door is closed. The door sill assembly may include a threshold. The threshold has a body. The body includes front and rear engagement parts integrally formed thereon to bring about first and second engagements respectively. The release of the second engagement is dependent on that of the first engagement.

17 Claims, 4 Drawing Sheets

(56) References Cited

U.S. PATENT DOCUMENTS

| | | | | |
|---|---|---|---|---|
| 8,413,383 | B2 * | 4/2013 | Van Camp | E06B 1/70 49/468 |
| 8,490,332 | B2 * | 7/2013 | Van Camp | E06B 3/9632 49/468 |
| 8,567,128 | B2 * | 10/2013 | Van Camp | E06B 1/70 49/468 |
| 8,739,469 | B1 * | 6/2014 | Fortun | E06B 1/70 49/460 |
| 8,857,107 | B1 * | 10/2014 | Key | E06B 1/70 49/460 |
| 8,925,258 | B1 * | 1/2015 | Header | E05D 15/00 16/90 |
| 8,966,823 | B1 * | 3/2015 | Van Camp | E06B 1/70 49/467 |
| 9,127,503 | B2 * | 9/2015 | Petta | E06B 1/70 |
| 9,528,314 | B2 * | 12/2016 | Mitchell | E06B 7/18 |
| 9,725,945 | B2 * | 8/2017 | Swank | E06B 1/70 |
| 2019/0264490 | A1 * | 8/2019 | Careri | E06B 7/2312 |

* cited by examiner

DOOR SILL ASSEMBLY FOR A DOOR

The present invention relates to a door sill assembly for use with a door, for example particularly, but not exclusively, a door sill assembly with adjustable height.

BACKGROUND OF THE INVENTION

A door sill is part of a door frame that extends along the bottom of the door frame. It usually sits directly on the foundation of the floor.

Instead of a solid piece of wood block, recent developments offer door sill in the form of an assembly with moveable parts. This permits adjustment of height of the door sill to offer flexibility. It is also an attempt to mitigate the cost implication on production of door sill with tailored height. Sill parts can be manufactured by mass production and the height adjustment is made on site.

Door sill with height adjustment can be used with doors of any heights. The adjustable door sill closes off any gaps between the door sill and the bottom of the door, which as a result offers good isolation from the external environment. A problem with the currently available height adjustment door sill is that adjustment must be made with the door opened. Either exact measurement of the gap is taken before the sill is adjusted or it will require some guess work and several attempts before the adjustment is made perfect.

To enhance durability of the door sill, it is common to cover the sill with a threshold which can be made of wood or metal. Existing thresholds are mounted by screws to the door sill. Caulk is used to seal the area between the threshold against the weather. The removal of an old threshold can be tricky. Some thresholds have screws clearly visible but on others they are hidden under a rubber center which has to be pulled off to get at the screws. These screws have to be taken out for the old threshold to be pulled off using a pry bar if necessary to release it from under the jambs. The procedure is rather cumbersome and time consuming.

The invention seeks to eliminate or at least to mitigate such shortcomings by providing a novel door sill assembly with adjustable height.

SUMMARY OF THE INVENTION

In a first aspect of the invention there is provided a door sill assembly for a door comprising a sill, having a lower portion and an adjustable upper portion positioned on the lower portion, wherein the adjustable upper portion is vertically displaceable relative to the lower portion by movement of an adjuster that is available for manipulation when said door is closed. Preferably, the door sill assembly further including an adjuster accessible for operation on one of front and rear sides of the lower portion. More preferably, the adjuster includes a lift in engagement with the adjustable upper portion which is vertically displaceable by or with movement of the lift. Yet more preferably, the lift is moveable in a first and second directions. It is preferable that the first direction is opposite to the second direction. More preferably, the first and second directions are opposite to one another and transverse to that of the vertical displacement of the adjustable upper portion. Yet more preferably, the lift and the adjustable upper portion are in engagement along a pair of slanted surfaces such that relative movement between the lift and the adjustable upper portion along the slanted surface and in the first and second directions bring about vertical displacement of the adjustable upper portion. It is preferable that the adjuster includes an actuator in connection with the lift and upon movement acts on the lift. In a preferred embodiment, angular movement of the actuator brings about linear movement of the lift in first and second direction which are opposite to one another. Advantageously, the actuator is in threaded engagement with the lift. More advantageously, the actuator has an exposed part for manipulation by a user to bring about a desired degree of angular movement of the connector and in turn a desired degree of the linear movement of the lift. It is advantageous that the adjustable upper portion has front and rear sides slidably engages the front and rear sides of the lower portion, which collectively defines an interior for accommodating the lift. Preferably, the lift and the adjustable upper portion are in engagement along a pair of slanted surfaces, the slanted surface of the adjustable upper portion extends across the interior for engaging the slanted surface of the lift. More preferably, the lower portion includes at least one indentation on its bottom side for application of silicone.

In a second aspect of the invention there is provided a threshold for a door sill, comprising a body, the body includes front and rear engagement parts integrally formed therewith to bring about first and second engagements with different parts of a said door sill, wherein release of the second engagement is dependent on that of the first engagement. Preferably, release of the second engagement is effected upon release of the first engagement. More preferably, the front engagement part extends in a direction transverse to that of the rear engagement part. Yet more preferably, the first engagement fixes the front engagement part to a said door sill against an upward movement, and the second engagement fixes the rear engagement part to a said door sill against a sideway movement. It is preferable that the rear engagement part comprises a round hook. Preferably, the threshold further includes a force-bearing part adjacent the front engagement part and on which a lever acts to release the first engagement. More preferably, the threshold further includes a fulcrum for supporting said lever that acts on the force-bearing part. Yet more preferably, the front engagement part and the force-bearing part are provided back to back and extends in substantially opposite directions.

In a third aspect of the invention there is provided a door sill assembly comprising a sill, and a threshold, wherein the sill and the threshold are configured to releasably interengage at first and second engagement positions to prevent relative movement of the sill and the threshold in respective directions. Preferably, the respective directions are transverse to each other.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

FIGS. 1 to 7 show a door sill assembly 100 according to the invention.

Figure 2:
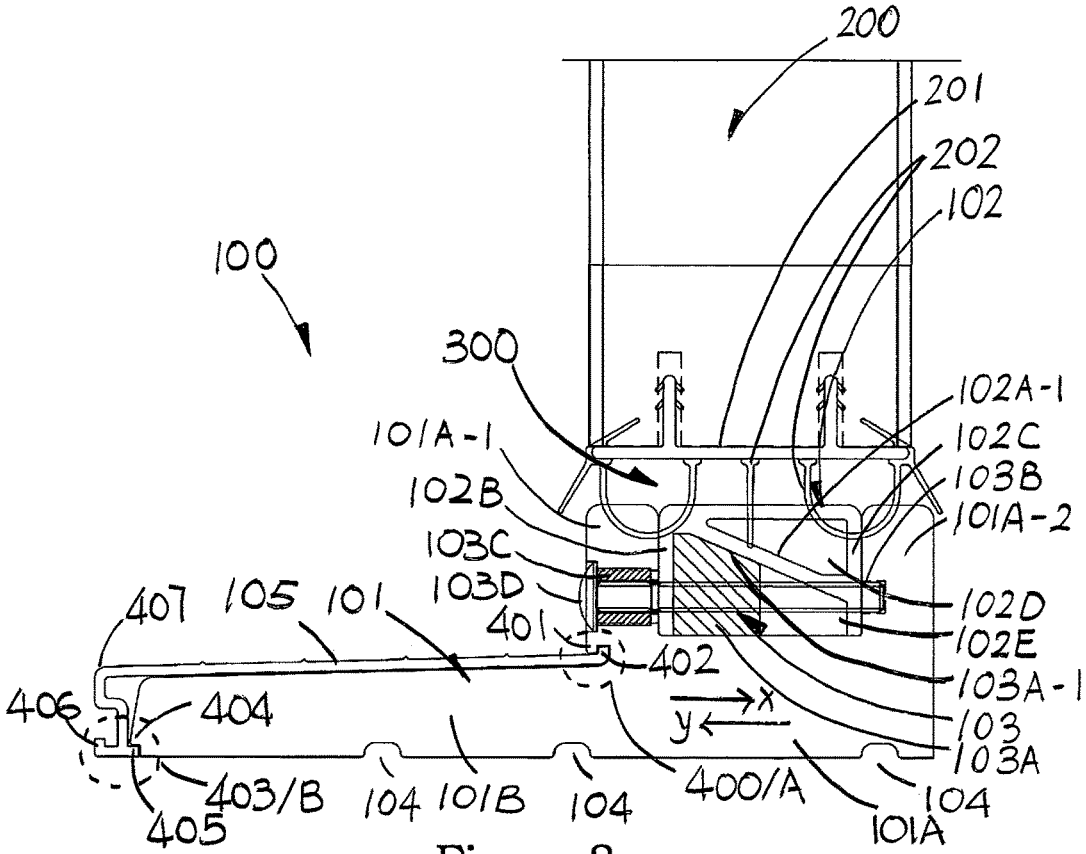
FIG. 2 is an illustrative cross-sectional view of the door sill assembly in FIG. 1 with a door provided thereabove.
Figure 3:
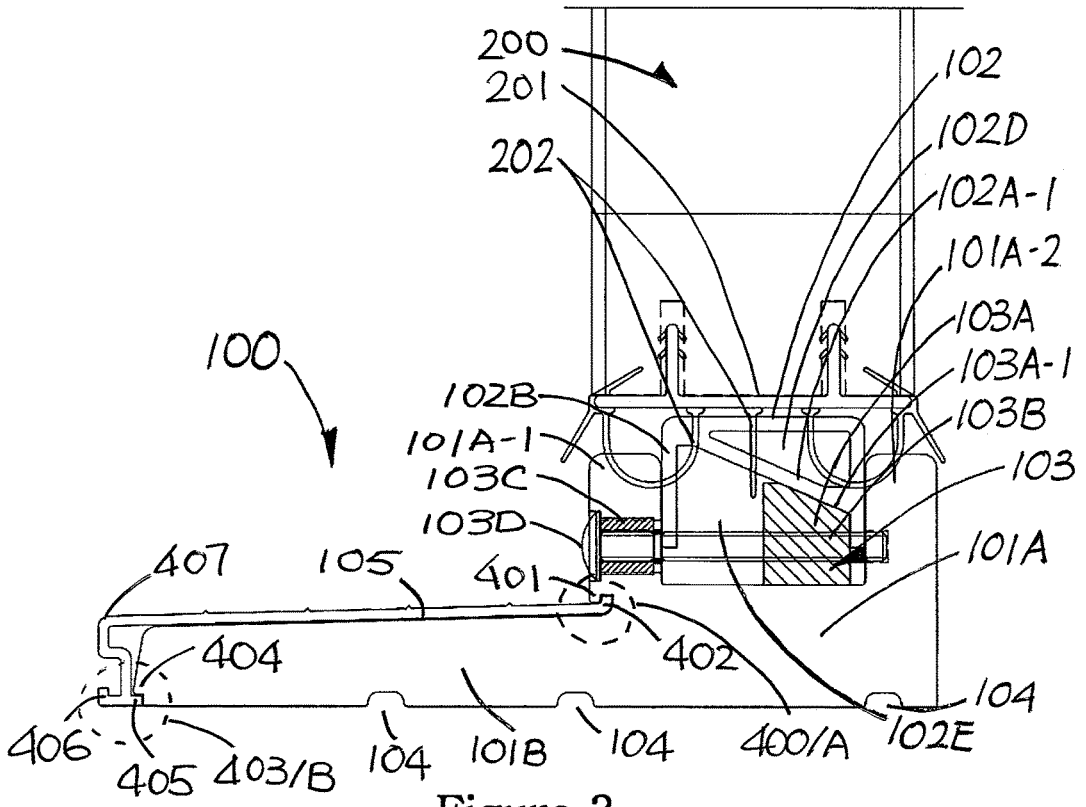
FIG. 3 is an illustrative cross-sectional view of the door sill assembly in FIG. 2 with its height being adjusted to seal off a gap between bottom of the door and upper surface of the door sill assembly.
Figure 4:
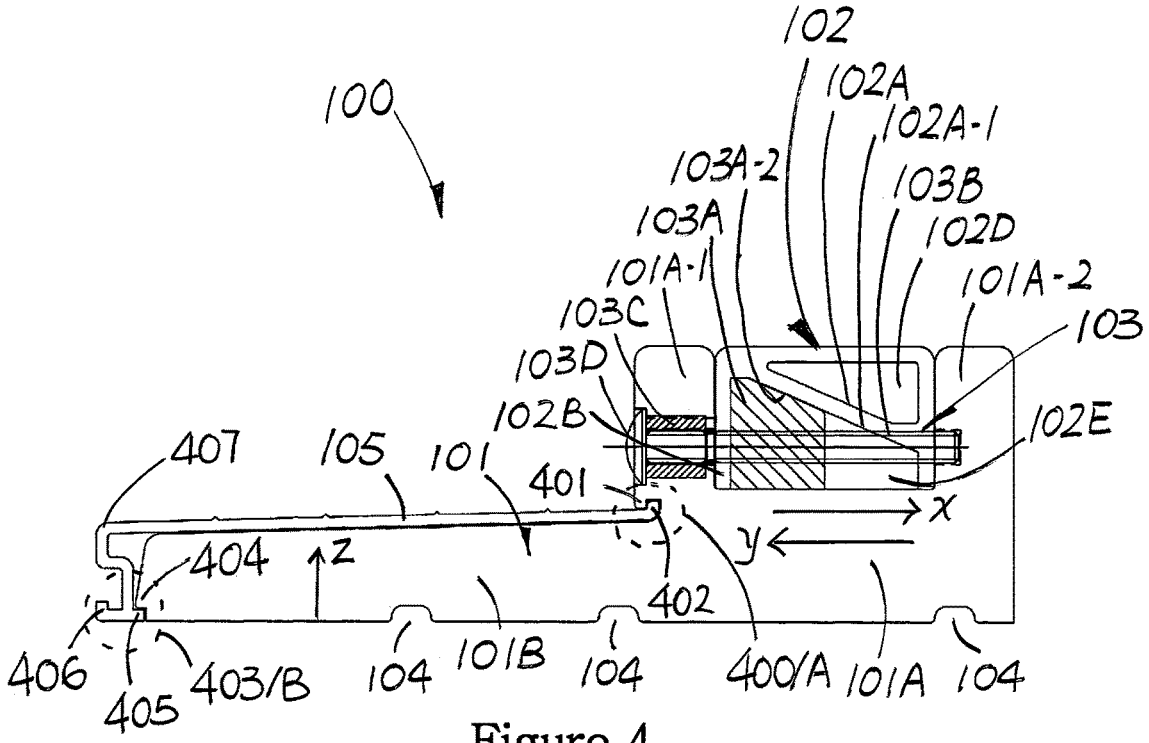
FIG. 4 is an illustrative cross-sectional view of the door sill assembly in FIGS. 1 to 3 with its height at a minimum.

As shown in FIGS. 2 and 3, when a door 200 is used with the door sill assembly 100, a gap 300 is left between bottom of the door 200 and top of the door sill assembly 100. The door 200 is a barrier against the external environment. The gap 300 must be sealed off to complete the barrier. To this end, it is common for conventional doors to include a changeable door bottom. In FIGS. 3 and 4, the door 200 is shown to have a replaceable door bottom 201 on its lower end. The door bottom 201 is equipped with fins 202 that function as weather guards. However the weather guards are readily deformable and hence may not be considered as the most effective barrier. Such door bottom 201 may be used with the door sill assembly 100 to enhance the guarding effect. As the fins 202 are deformable, it will be compressed to form a seal between the bottom of the door 200 and the door sill assembly 100. The extent to which the fins 202 are deformable depends on the material that forms the fins 202 and their relative positions. It is therefore difficult to take measure that reflects on the extent of adjustment required. As the height of the door sill assembly 100 can be adjusted with the door closed, hence the fins 202 in place, adjustment is made easy.

Referring to FIGS. 1 to 5, the door sill assembly 100 is an assembly of various sill parts, which includes a lower portion 101 and an adjustable upper portion 102 positioned on the lower portion 101. The lower portion 101 has a U-shaped bracket 101A for supporting the adjustable upper portion 102 as well as a platform 101B that extends from a side of the U-shaped bracket 101A to support a threshold 105. The adjustable upper portion 102 is an inverted U-shaped bracket dimensioned to fit into the U-shaped bracket 101A. Front and rear walls 102B and 102C of the adjustable upper portion 102 slidably engage corresponding front/exterior and rear/interior walls 101A-1 and 101A-2 of the U-shaped bracket 101A to form an expandable and retractable box-like structure with a generally hollow interior. The adjustable upper portion 102 is vertically displaceable relative to the U-shaped bracket 101A of the lower portion 101 to adjust the height of the overall box-like structure.

In the embodiment as shown in FIGS. 1 to 7, the U-shaped bracket 101A and the platform 101B are integrally formed as a one piece structure which may be made of wood or metal. Bottom of the U-shaped bracket 101A and the platform 101B collectively form the bottom of the door sill assembly 100. A number of indentations in the form of troughs 104 are formed on the bottom of the door sill assembly 100 for application of silicone to function as seals against water.

An adjuster 103 is provided to bring about vertical displacement of the adjustable upper portion 102 relative to the U-shaped bracket 101A in a controllable manner. The adjuster 103 is available for manipulation by a user when the door 200 is closed such that precise measurement of the gap 300 is not required. Effortlessly, the bottom of the door 200 acts as the upper limit for the adjustment.

The adjuster 103 includes a lift 103A and an actuator 103B. The actuator 103B has a cap 103D provided at its free end.

The lift 103A is placed inside the hollow interior defined by the U-shaped bracket 101A and the adjustable upper portion 102. The adjustable upper portion 102 and the lift 103A are in engagement along a pair of slanted surfaces 102A and 103A-1 to bring about vertical displacement of the adjustable upper portion 102 by or with movement of the lift 103A.

The pair of slanted surfaces 102A and 103A-1 are complementary in the sense that the slanted surface 103A-1 and the slanted surface 102A have the same direction and degree of inclination. With reference to FIGS. 2 to 6, the slanted surfaces 103A-1 and 102A are both sloping downwardly in a first direction X.

As shown in each of FIGS. 1 to 5, the adjustable upper portion 102 includes a slanted wall 102A-1, on which the slanted surface 102A is provided, which extends between the front and rear walls 102B and 102C. Within the adjustable upper portion 102, the slanted wall 102A-1 divides interior of the adjustable upper portion 102 into upper and lower spaces 102D and 102E. The upper space 102D has a triangular cross-sectional shape while the lower space 102E has a trapezoidal cross-sectional shape when taken at the first direction X. The lift 103A is sized and dimensioned to fit into the lower space 102E.

Figure 5:
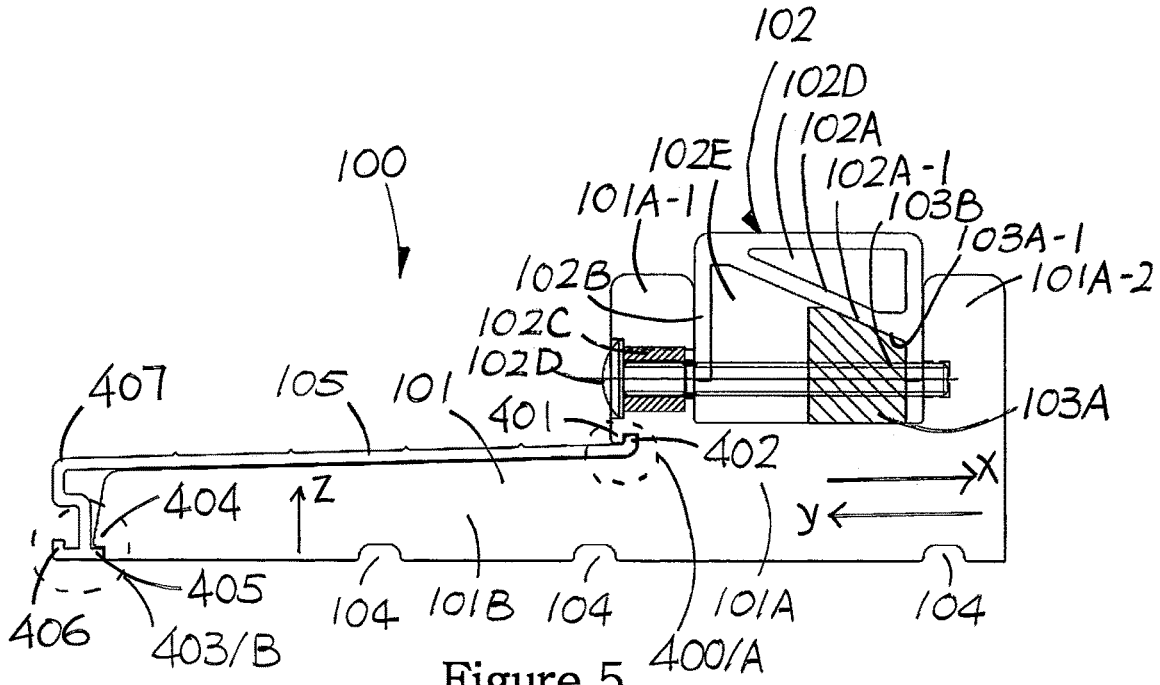
FIG. 5 is an illustrative cross-sectional view of the door sill assembly in FIG. 4 with its height being adjusted to a maximum.

By comparing FIGS. 2 and 3 as well as FIGS. 4 and 5, the overall arrangement allows the adjustable upper portion 102 to be displaced vertically upward as the lift 103A is moved in the first direction X. When the lift 103A is moved in a second direction Y, opposite that of the first direction X, the adjustable upper portion 102 is displaceable vertically downward. As a result, the displacement of the adjustable upper portion 102 is reversible. It can be appreciated from the FIGS. 1 to 5, the adjustable upper portion 102 is displaced vertically downward on its own weight under the action of gravity and is pushed by the lift 103A to move vertically upward against the action of gravity.

The lift 103A is in threaded connection with the actuator 103B. The actuator 103B has an elongated portion with threaded outer surface. A threaded aperture 103A-2 extends through center of the lift 103A along one dimension thereof. The actuator 103B is screwed into the aperture 103A-2 for establishing the threaded connection.

The actuator 103B runs through an aperture in the front/exterior wall 101A-1 via a gasket 103C and through an opening in the front wall 102B. The opening in the front wall 102B is an elongated aperture extending along height of the front wall 102B to accommodate the actuator 103B as the front/exterior wall 101A-1 slides over the front wall 102B in response to the movement of the lift 103 in the first and second directions X and Y. The actuator 103B remains rotatable in the gasket as well as in the opening on the front wall 102B. The cap 103D is an exposed part of the adjuster 103B and is accessible from outside of the front/exterior wall 101A-1 for manipulation by a user irrespective of the position of the door 200.

Figure 1:
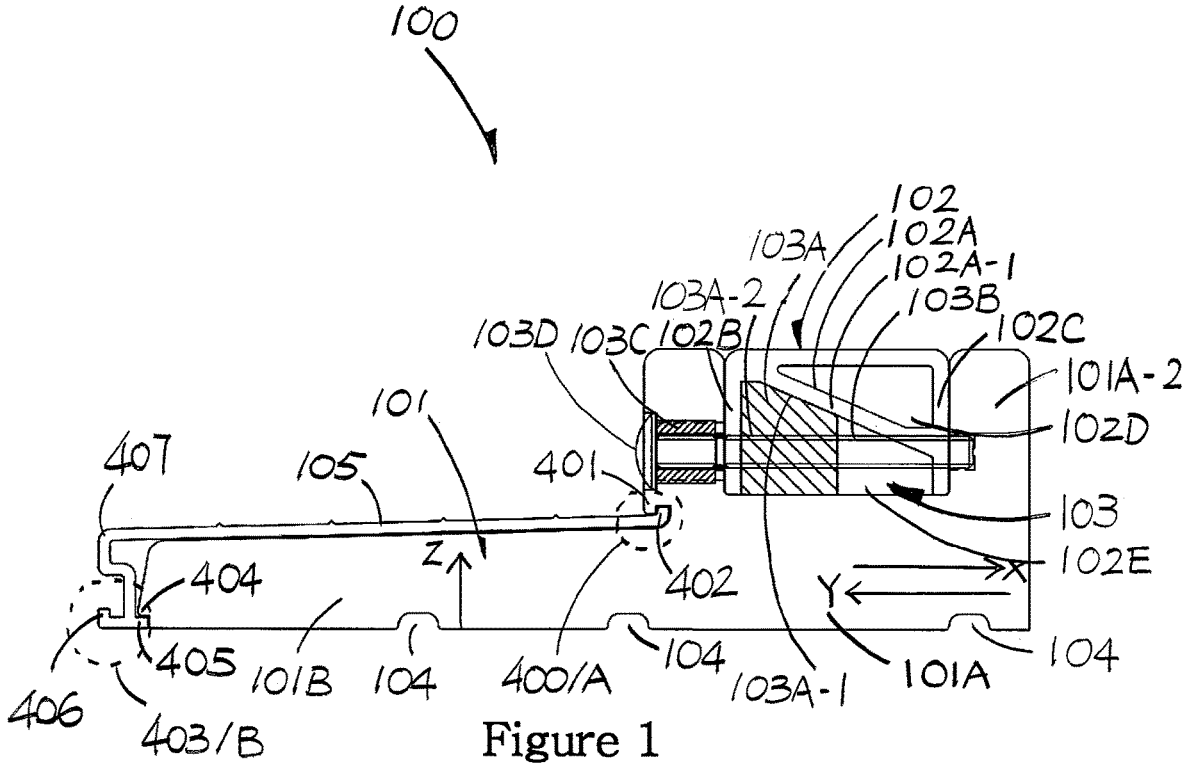
FIG. 1 is an illustrative cross-sectional view of a door sill assembly of the invention.

With reference to FIG. 3 and FIG. 5, clockwise rotation of the actuator 103B brings about the movement of the lift 103A in the first direction X and thereby pushes the adjustable upper portion 102 to displace vertically upward. In both of FIGS. 3 and 5, the door sill assembly 100 reaches its maximum adjustable height. With reference to FIGS. 1, 2 and 4, an anti-clockwise rotation of the actuator 103B brings about movement of the lift 103A in the second direction Y that permits the adjustable upper portion 102 to displace vertically downward on its own weight. The door sill assembly 100 reaches its minimum adjustable height in FIGS. 1, 2 and 4. It follows that the first and second directions X and Y are both transverse to the vertical displacement of the adjustable upper portion 102. This is best illustrated in FIGS. 2 to 5. The adjuster 103 acts as a transmission to transform an angular motion in the cap 103C and the actuator 103B to a horizontal linear motion in the lift 103A which is then translated into the vertical linear motion of the adjustable upper portion 102.

In each of FIGS. 1 to 7, there is a threshold 105 with a threshold body placed on and mounted to the platform 101B of the lower portion 101. The threshold 105 is prevented from movement relative to the lower portion 101 in at least the second direction Y and a third direction Z. The second and the third directions Y and Z are transverse to one another. This is made possible by a two-point engagement between the threshold 105 and the lower portion 101. With reference to FIGS. 1 to 7, The threshold 105 has a rear engagement part/coupler 402 that is engaged to a coupler 401 on the front/exterior wall 101A-1 of the lower portion 101 to form a second inter-engagement 400 between the threshold 105 and the lower portion 101. The second engagement 400 is at a second engagement position A. It involves an inter-engagement between the couplers 401 and 402, one being provided at a root of the front/exterior wall 101A-1 and the other on a rear end of the threshold 105. The coupler 402 is preferably a round hook that is 90 degree angularly apart from the threshold body The threshold 105 is also engaged to the platform 101B at a first engagement position B by a first engagement 403. The first inter-engagement 403 includes a front engagement part 405 on a front end of the threshold 105 and a coupler 404 on the front end of the platform 101B. A force-bearing member 406 is provided back to back with the front engagement part 405 on the front end of the threshold 105. A fulcrum 407 is also provided adjacent the front engagement part 405 to support a lever used in removing the threshold 105.

Figure 6:
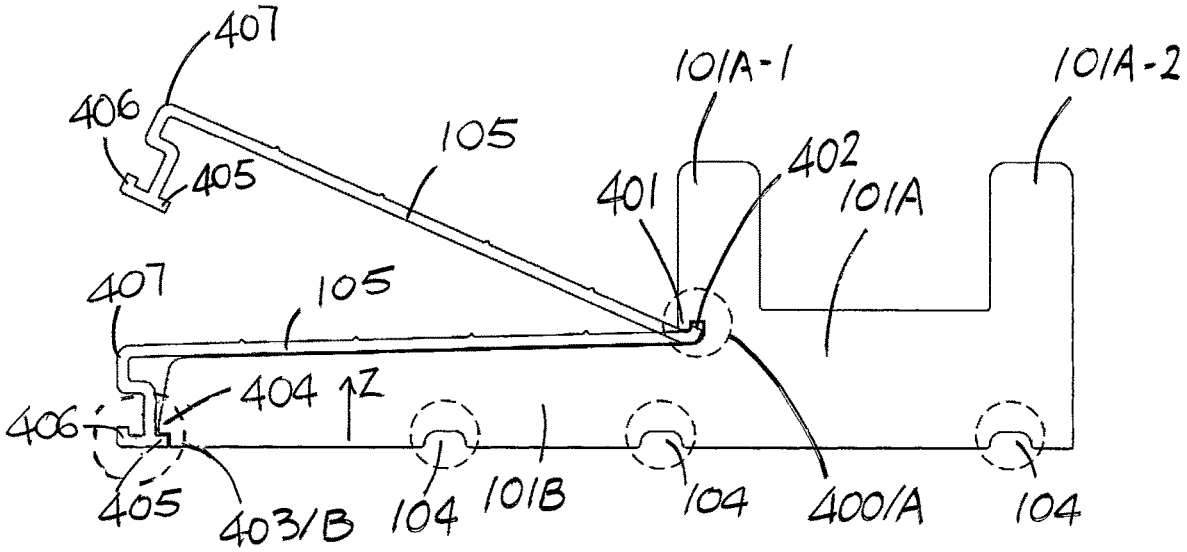
FIG. 6 is an illustrative cross-sectional view of a lower portion of the door sill assembly as shown in FIGS. 1 to 5, the drawing illustrates the mounting of a threshold of the invention to the lower portion of the door sill.

With reference to FIG. 6, to fasten the threshold 105 to the lower portion 101, the couplers 402 and 401 are interengaged by inserting the coupler 402 into the coupler 401. Thereafter the front engagement part 405 is snap fit to the coupler 404 by pushing the threshold 105 towards the platform 101B. The front wall of the threshold 105 is slightly deformed to when the front engagement part 405 travels along the front wall of the platform 105 to reach the coupler 405.

The front engagement part 405 extends in a direction transverse to that of the rear engagement part 402. The first inter-engagement 403 fixes the front engagement part 405 to the lower portion 101 against an upward movement, and the second inter-engagement 400 fixes the rear engagement part 402 to the lower 101 against a sideway movement.

Figure 7:
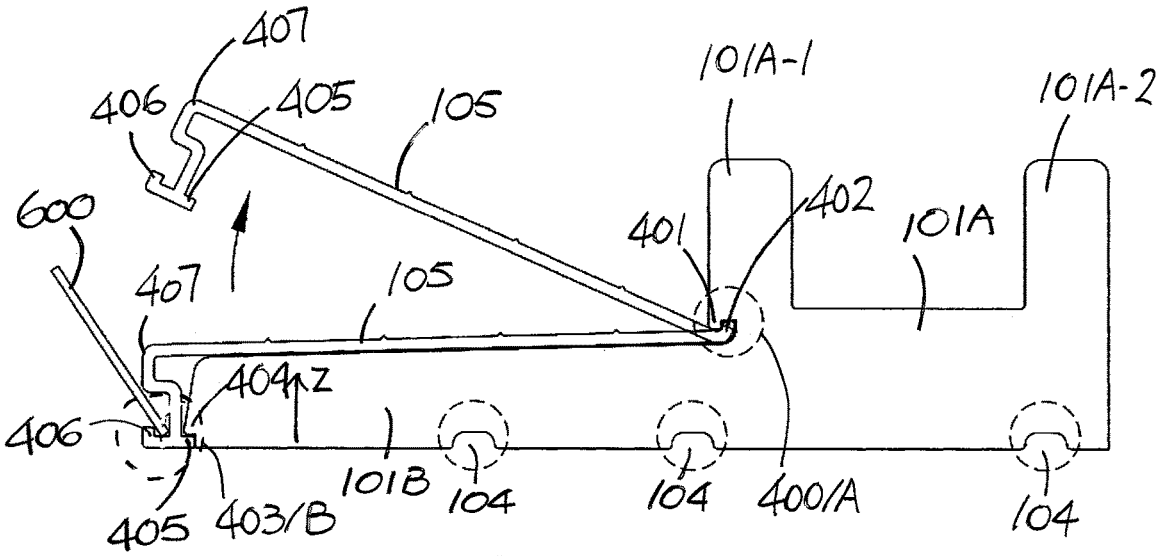
FIG. 7 is an illustrative cross-sectional view of the lower portion and the threshold in FIG. 6, the drawing illustrates the removal of the threshold from the lower portion of the door sill.

With reference to FIG. 7, to remove the threshold 105 from the lower portion 101, a lever 600 is used. The lever 600, being supported by the fulcrum 407, acts on the force-bearing member 406 to move the front engagement part 405 away from the coupler 404 thereby disengage the interengagement 403. This would again involve deformation of the front wall of the threshold 105 at about the first engagement position B. Thereafter the threshold 105 is pivoted at the second engagement position A until the rear engagement part 402 can be released from the coupler 401. The release of the second interengagement 400 is dependent on that of the first interengagement 403. More specifically, the release of the second engagement is effected upon release of the first engagement.

The threshold 105 is a one-piece formation and preferably made from metal.

The invention has been given by way of example only, and various other modifications of and/or alterations to the described embodiment may be made by persons skilled in the art without departing from the scope of the invention as specified in the appended claims.

As an example, an alternative embodiment may involve the same door sill assembly 100 as shown in the FIGS. 1 to 5 with a horizontal wall 102A-1, instead of a slanted wall, and an eccentric round lift 103A, instead of a lift with a trapezoidal cross-sectional shape. The angular motion or rotation of the actuator 103B causes the eccentric lift 103A to rotate. The angular movement of the lift 103A brings about vertical displacement of the adjustable upper portion 102.

Another embodiment would involve the same door sill assembly 100 as discussed above but replacing the actuator 103B, the gasket 103C and the cap 103D with a lever. The lever supports the lift 103A at one end and provides a paddle at the other. When the paddle moves downward, the lift 103A is moved upward to a raised position thereby bring about the vertical displacement of the adjustable upper portion 102. The paddle of the lever may be manipulated by a foot of a user. A retractable retainer should be provided with the lift 103A to retain it at the raised position.

In a further embodiment, the actuator 103 may be manipulated on the front/exterior wall 101A-1 as well as the rear/interior wall 101A-2.

The invention claimed is:

1. A door sill assembly for a door, the door sill assembly comprising: a sill comprising a front side facing outside of said door and a rear side facing inside of said door, a lower portion and an adjustable upper portion positioned on the lower portion, wherein the lower portion and the adjustable upper portion are positioned between the front and rear sides; wherein the lower portion is a one piece structure comprising a U-shaped bracket and a platform which are integrally formed, an interior being defined by the adjustable upper portion and the U-shaped bracket, wherein the adjustable upper portion and the U-shaped bracket are slidably engaged, an adjuster comprising a lift positioned in the interior and in engagement with the adjustable upper portion, the adjustable upper portion configured to be vertically displaced by or with movement of the lift, wherein a direction of movement of the lift is perpendicular to a direction of the vertical displacement of the adjustable upper portion, the lift is configured to be manipulated from the front side of the sill to permit adjustment of the sill when said door is closed, and wherein the platform is covered by a threshold, the threshold comprising a body that includes front and rear engagement parts integrally formed therewith to bring about first and second engagements with different parts of said door sill, wherein release of the second engagement is dependent on release of the first engagement.

2. The door sill assembly as claimed in claim 1, wherein the lift is moveable in-a first and second directions.

3. The door sill assembly as claimed in claim 2, wherein the first direction is opposite to the second direction.

4. The door sill assembly as claimed in claim 3, wherein the lift and the adjustable upper portion are in engagement along a pair of slanted surfaces such that relative movement between the lift and the adjustable upper portion along the pair of slanted surfaces and in the first and second directions bring about vertical displacement of the adjustable upper portion.

5. The door sill assembly as claimed in claim 1, wherein the adjuster includes an actuator in connection with the lift, and the actuator is configured to act on the lift when the actuator is moved.

6. The door sill assembly as claimed in claim 5, wherein angular movement of the actuator brings about linear movement of the lift in first and second direction which are opposite to one another.

7. The door sill assembly as claimed in claim 6, wherein the actuator is in threaded engagement with the lift.

8. The door sill assembly as claimed in claim 6, wherein the actuator includes an exposed part and a connector that is in threaded engagement with the lift, the exposed part is provided for manipulation by a user to bring about a target degree of angular movement of the connector and in turn a target degree of the linear movement of the lift.

9. The door sill assembly as claimed in claim 1, wherein the lift and the adjustable upper portion are in engagement along a pair of slanted surfaces, slanted surface of the adjustable upper portion extends across the interior for engaging slanted surface of the lift.

10. The door sill assembly as claimed in claim 1, wherein the lower portion includes at least one indentation on its bottom side for application of silicone.

11. The door sill assembly as claimed in claim 1, wherein the release of the second engagement is effected upon release of the first engagement.

12. The door sill assembly as claimed in claim 1, wherein the front engagement part extends in a direction transverse to that of the rear engagement part.

13. The door sill assembly as claimed in claim 12, wherein the first engagement fixes the front engagement part to said door sill against an upward movement of the threshold, and the second engagement fixes the rear engagement part to said door sill against a sideway movement of the threshold.

14. The door sill assembly as claimed in claim 12, wherein the rear engagement part comprises a round hook.

15. The door sill assembly as claimed in claim 1, further comprising a force-bearing part adjacent the front engagement part configured to be acted on by a lever to release the first engagement.

16. The door sill assembly as claimed in claim 15, further comprising a fulcrum configured to support said lever that acts on the force-bearing part.

17. The threshold as claimed in claim 15, wherein the front engagement part and the force-bearing part are provided back to back and extend in substantially opposite directions.

* * * * *